US006123433A

United States Patent [19]

Chen

[11] Patent Number: 6,123,433

[45] Date of Patent: Sep. 26, 2000

[54] CHRISTMAS TREE LIGHT

[76] Inventor: Ching-Chao Chen, No. 511, Sec. 3, Dong Ta Rd., Hsinchu City, Taiwan

[21] Appl. No.: 09/477,409

[22] Filed: Jan. 4, 2000

[51] Int. Cl.[7] ..... H01R 33/00

[52] U.S. Cl. ..... 362/226; 362/249; 362/806; 439/619

[58] Field of Search ..... 362/123, 226, 362/249, 252, 267, 806, 396; 439/277, 280, 619, 699.2, 702

[56] References Cited

U.S. PATENT DOCUMENTS

| | | | |
|---|---|---|---|
| 5,685,638 | 11/1997 | Huang | 362/226 |
| 5,722,860 | 3/1998 | Pan | 439/619 |
| 5,735,597 | 4/1998 | Weng | 362/249 |
| 5,908,238 | 6/1999 | Huang | 362/806 |

*Primary Examiner*—Y. Quach
*Attorney, Agent, or Firm*—Varndell & Varndell, PLLC

[57] ABSTRACT

A Christmas tree light includes a socket shell having a top receiving chamber and an outward top flange, an insulative block mounted in the top receiving chamber inside the socket shell, the insulative block having two longitudinal grooves at two opposite sides, a bulb supported on the insulative block inside the top receiving chamber, the bulb having two lead-out wires separated by the insulative block, a socket cap covered on the socket shell to hold the bulb in place, the socket cap having an inward bottom flange hooked on the outward top flange of the socket shell, two terminals respectively hooked in the longitudinal grooves at the insulative block and connected to the lead-out wires of the bulb, and two conductors connected to the terminals for providing electricity to the bulb.

1 Claim, 5 Drawing Sheets

CHRISTMAS TREE LIGHT

BACKGROUND AND SUMMARY OF THE INVENTION

The present invention relates to Christmas tree lights, and more particularly to such a Christmas tree light, which achieves satisfactory waterproof and electric leakage-proof effects.

A regular Christmas tree light, as shown in FIGS. 1 and 2, is generally comprised of a flexible socket shell 6, a flexible lamp holder 5 mounted inside the flexible socket shell 6, a bulb 4 installed in the flexible lamp holder 5, the bulb having two lead-out wires 41 respectively extended out of the flexible lamp holder 5, two terminals 71 respectively mounted inside the flexible socket shell 6 and connected to the lead-out wires 41 of the bulb 4, and two conductors 7 respectively connected to the terminals 71 to provide electricity of the bulb 4. This structure of Christmas tree light has numerous drawbacks as outlined hereinafter.

1. The bulb 4, the flexible lamp holder 5 and the flexible socket shell 6 can not be tightly secured to one another, and rainwater may pass to the inside of the Christmas tree light.

2. The conductors 7 tend to be displaced in the flexible socket shell 6, causing a short-circuit.

3. The terminals 71 commonly have a sharp positioning flange 711 for positioning in the flexible socket shell 6, however the sharp positioning flange 711 tends to be disconnected from the inside wall of the flexible socket shell 6 when the corresponding conductor 7 is stretched.

It is one object of the present invention to provide a Christmas tree light, which keeps the parts thereof firmly in position when assembled. It is another object of the present invention to provide a Christmas tree light, which achieves a satisfactory waterproof effect. It is still another object of the present invention to provide a Christmas tree light, which is safe in use. According to the present invention, the Christmas tree light comprises a socket shell having a top receiving chamber and an outward top flange, an insulative block mounted in the top receiving chamber inside the socket shell, the insulative block having two longitudinal grooves at two opposite sides, a bulb supported on the insulative block inside the top receiving chamber, the bulb having two lead-out wires separated by the insulative block, a socket cap covered on the socket shell to hold the bulb in place, the socket cap having an inward bottom flange hooked on the outward top flange of the socket shell, two terminals respectively hooked with respective hooked portion in the longitudinal grooves at the insulative block and connected to the lead-out wires of the bulb, and two conductors connected to the terminals for providing electricity to the bulb. Further, the bulb has a plane at the broad lower section engaged with a plane in the receiving chamber inside the socket shell. The socket cap is closely attached to the periphery of the bulb and secured to the outward top flange of the socket shell, it effectively prohibits rainwater from passing to the inside of the Christmas tree light. Because the insulative block separates the conductors and the terminals in the socket shell, the Christmas tree light effectively prevents the occurrence of a short circuit between the terminals. Because the terminals have a respective hooked portion respectively hooked in the longitudinal grooves at two opposite sides of the insulative block, the terminals are firmly retained in place, and kept connected to the lead-out wires of the bulb positively. Further, because the bulb has a plane at the broad lower section engaged with a plane in the receiving chamber inside the socket shell, the bulb is prohibited from rotary motion relative to the socket shell.

DETAILED DESCRIPTION OF THE PREFERRED EMBODIMENT

Figure 1:
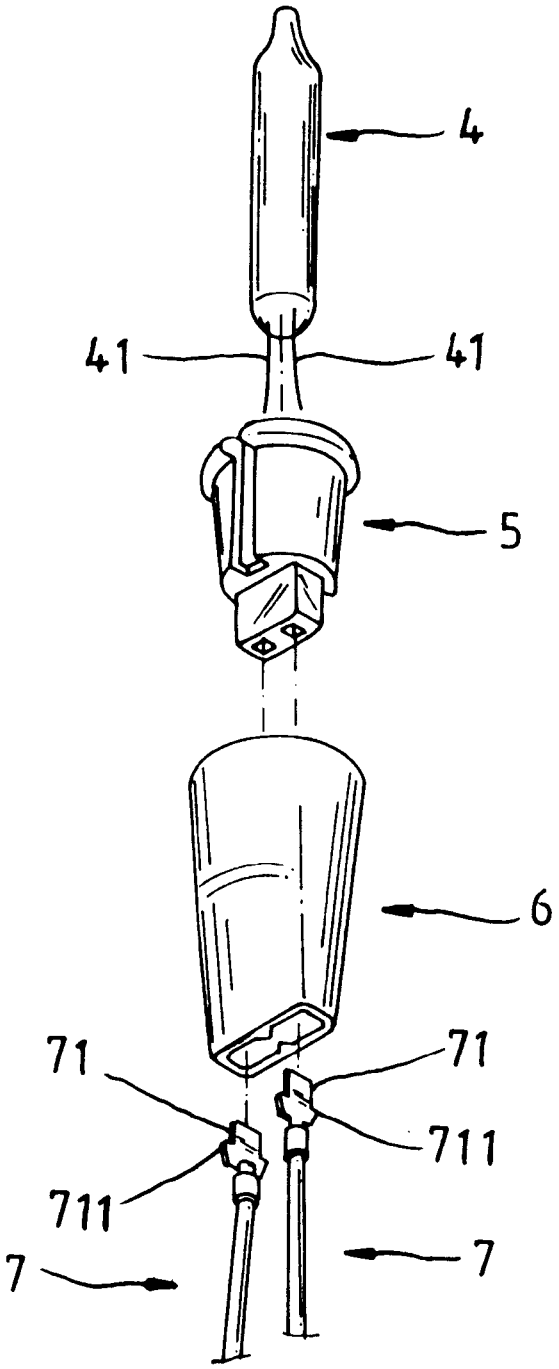
Fig. 1 PRIOR ART
FIG. 1 is an exploded view of a Christmas tree light according to the prior art.
Figure 2:
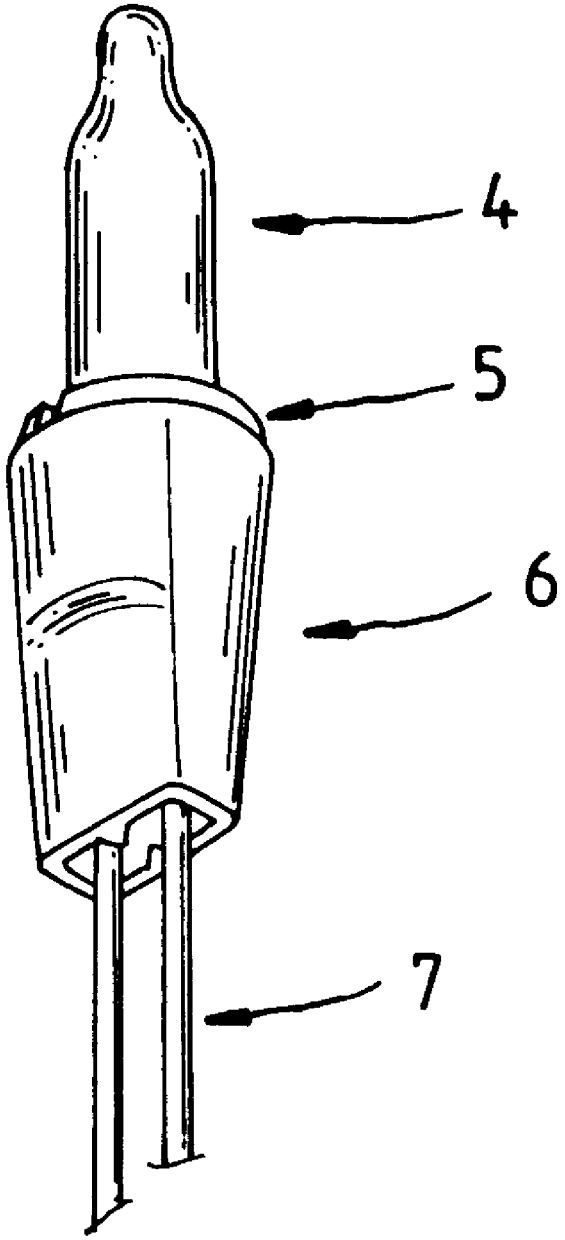
Fig. 2 PRIOR ART
FIG. 2 is an assembly view of a Christmas tree light shown in FIG. 1.
Figure 3:
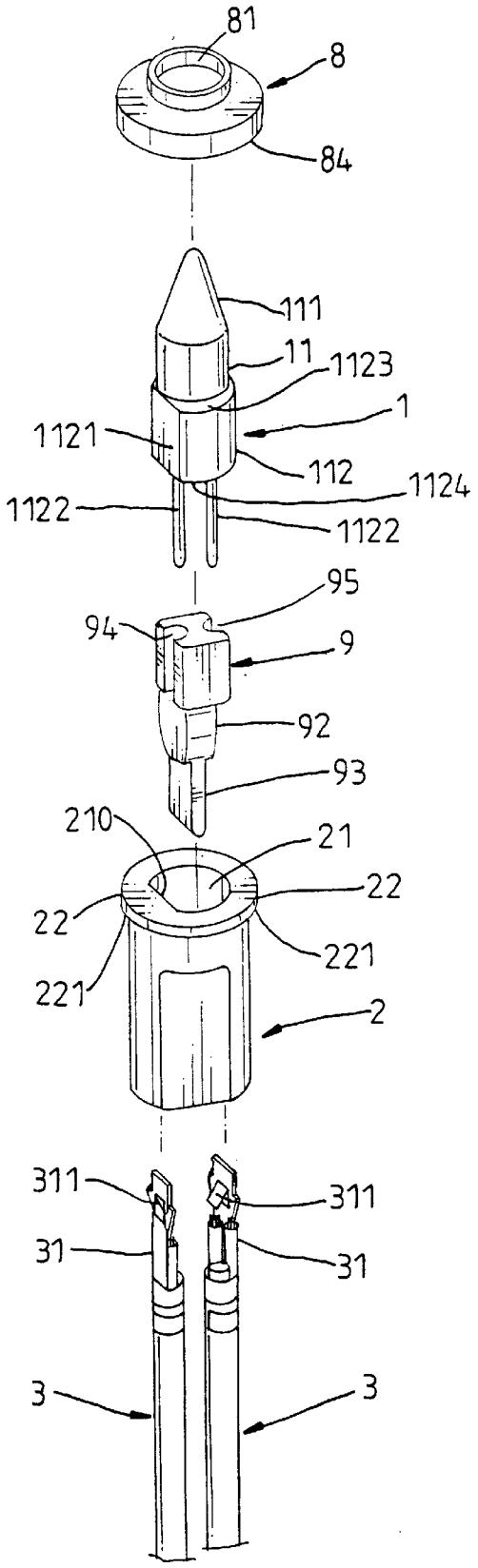
FIG. 3 is an exploded view of a Christmas tree light according to the present invention.
Figure 4:
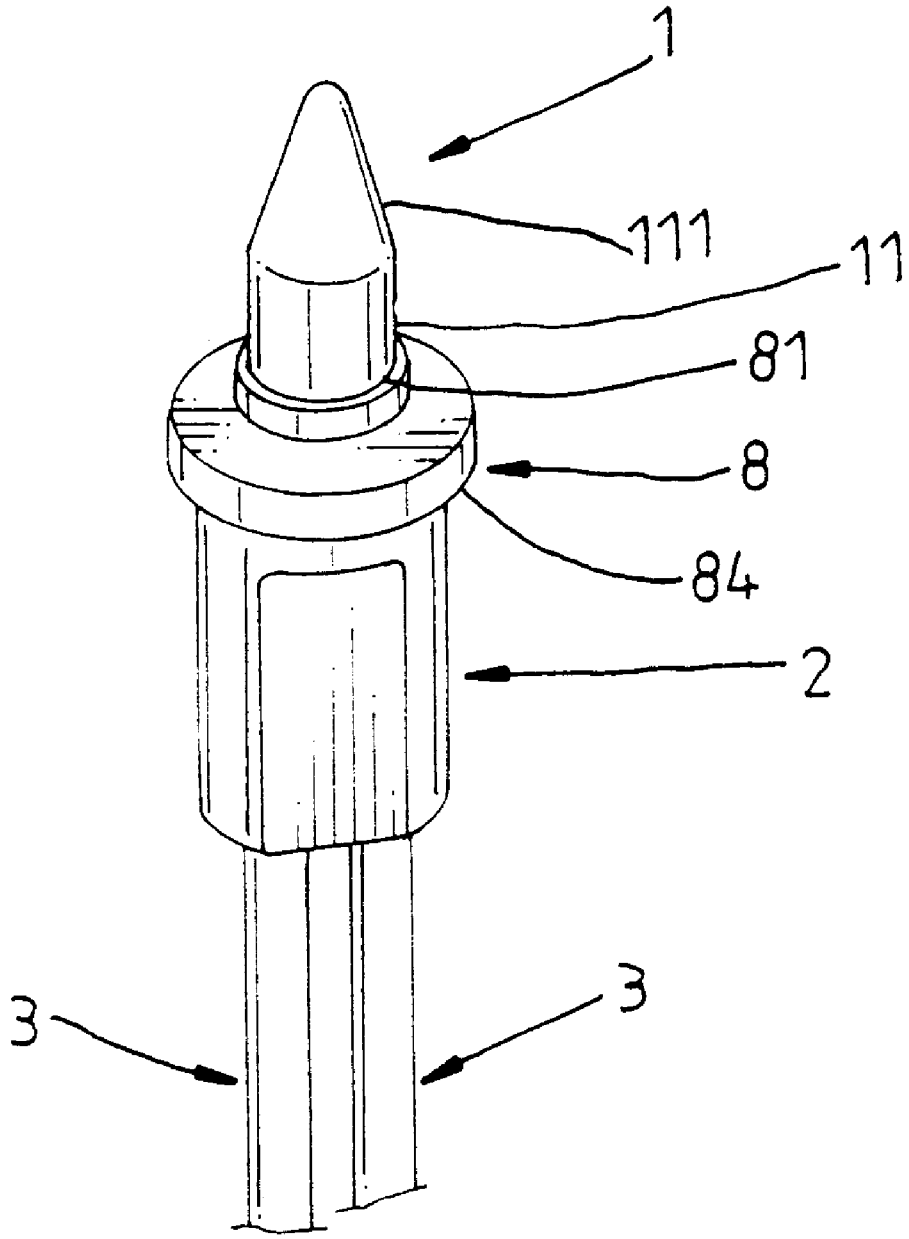
FIG. 4 is an assembly view of a Christmas tree light shown in FIG. 3.
Figure 5:
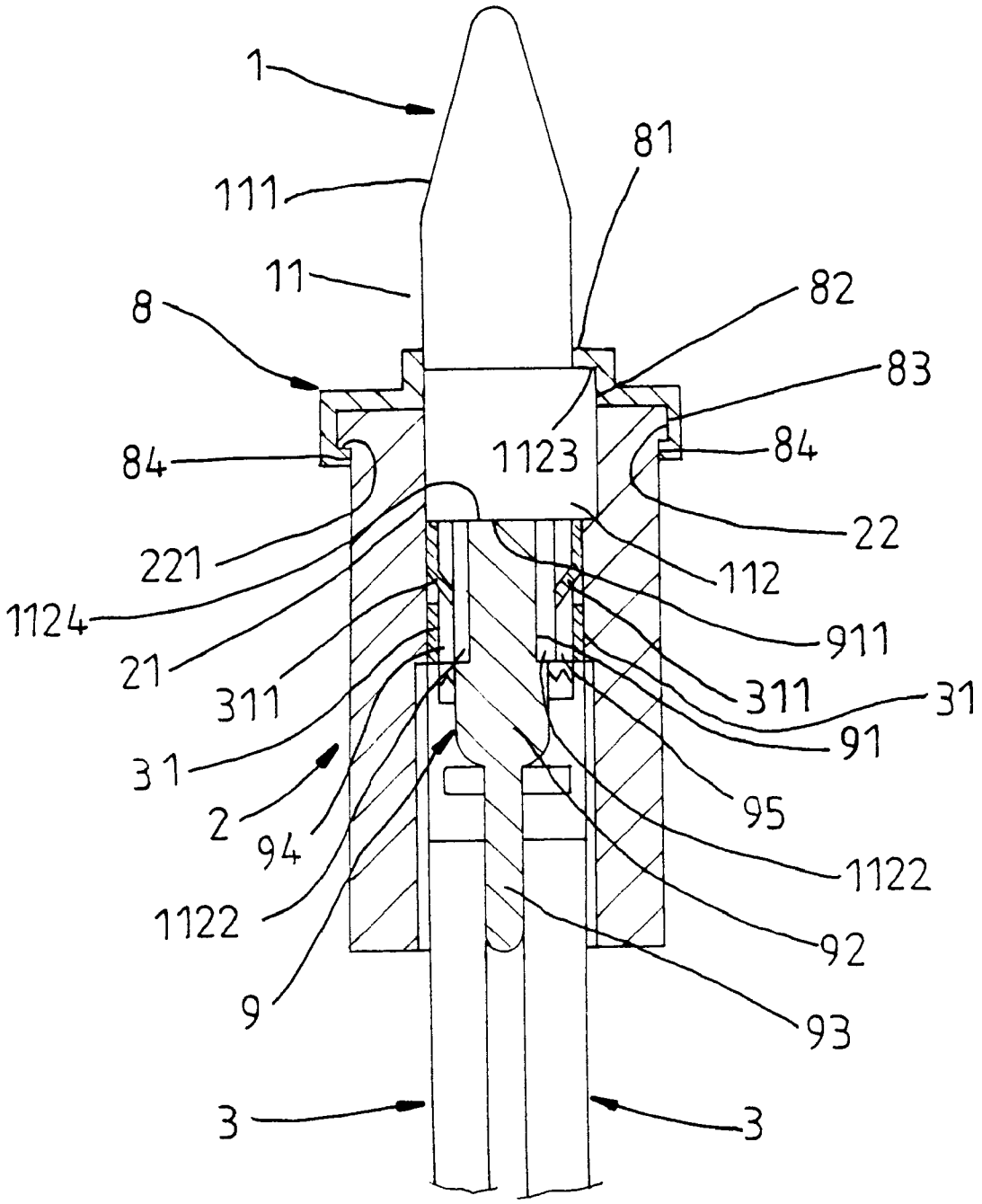
FIG. 5 is a sectional view in an enlarged scale of FIG. 5.

Referring to FIGS. from 3 through 5, a Christmas tree light in accordance with the present invention is generally comprised of a socket cap 8, a bulb 1, an insulative block 9, a flexible socket shell 2, two terminals 31, and two conductors 3. The bulb 1 can be a light emitting diode. The body 11 of the bulb 1 comprises a conical upper section 111, a broad lower section 112, a step 1123 disposed between the conical upper section 111 and the broad lower section 112, a plane 1121 at one side of the broad lower section 112 and two lead-out wires 1122 extended out of the bottom side wall 1124 of the broad lower section 112. The socket shell 2 comprises a receiving chamber 21 longitudinally extended to the topside thereof for receiving the bulb 1. The terminals 31 are respectively mounted inside the socket shell 2. The bulb 1 is mounted in the socket shell 2 and supported on the insulative block 9, enabling the lead-out wires 1122 to be respectively connected to the terminals 31. The conductors 3 are respectively inserted into the socket shell 2 and connected to the terminals 31 for providing electricity to the bulb 1.

The socket shell 2 further comprises an outward top flange 22, and a plane 210 longitudinally disposed inside the receiving chamber 21 and engaged with the plan 1121 at the broad lower section 112 of the body 11 of the bulb 1. The socket cap 8 comprises a center through hole 81 through which the conical upper section 111 of the body 11 of the bulb passes, a first inside coupling groove 82, which receives the upper part of the broad lower section 112 of the body 11 of the bulb 1, enabling the step 1123 to be stopped at the top side wall of the first inside coupling groove 82, a second inside coupling groove 83, which receives the top flange 22 of the socket shell 2, and an inward coupling flange 84 disposed at the bottom side thereof and hooked on the bottom side wall 221 of the top flange 22. The insulative block 9 is mounted inside the socket shell 2 to support the bulb 1, comprising a head 91, a flat tail 93, and an intermediate section 92 connected between the head 91 and the flat tail 93. The head 91 of the insulative block 9 comprises a top side wall 911 stopped at the bottom side wall 1124 of the broad lower section 112 of the body 11 of the bulb 1, and two longitudinally extended side grooves 94 and 95, which receive the lead-out wires 1122 of the bulb 1. The terminals 31 are respectively mounted inside the socket shell 2 and separated by the insulative block 9, each having a hooked portion 311 respectively hooked in the longitudinally extended side grooves 94 and 95 at the insulative block 9.

What is claimed is:

1. A Christmas tree light comprising a socket shell having a top receiving chamber, an insulative block mounted in said top receiving chamber inside said socket shell, a bulb mounted, inserted into said top receiving chamber and supported on said insulative block, said bulb comprising a conical upper section, a broad lower section, a step connected between said conical upper section and said broad lower section, and two lead-out wires extended out of said broad lower section at a bottom side, of said broad lower section a socket cap covered on said socket shell to hold said bulb in place, two terminals respectively mounted inside said socket shell at two opposite sides of said insulative block and respectively connected to the lead-out wires of said bulb, and two conductors respectively connected to said terminals and extended out of said socket shell for connection to power supply, wherein said socket shell comprises an outward top flange; said socket cap comprises a center through hole through which the conical upper section of said bulb passes, a first inside coupling groove, of said socket cap which receives an upper part of the broad lower section of said bulb, enabling the step of said bulb to be stopped at a top side wall of said first inside coupling groove, a second inside coupling groove, of said socket cap which receives the top flange of said socket shell, and an inward coupling flange of said socket cap disposed at a bottom side thereof and hooked on a bottom side wall of the top flange of said socket shell; said insulative block comprises a head stopped against the broad lower section of said bulb at a bottom side between the lead-out wires of said bulb, a flat tail, and an intermediate section connected between said head and said flat tail to separate said conductors, said head of said insulative block comprising two longitudinally extended side grooves, which receive the lead-out wires of said bulb and said terminals.

* * * * *